US005218739A

United States Patent [19]

Lautenschläger

[11] Patent Number: 5,218,739

[45] Date of Patent: Jun. 15, 1993

[54] SINGLE-JOINT FURNITURE HINGE

[75] Inventor: Reinhard Lautenschläger, Reinheim, Fed. Rep. of Germany

[73] Assignee: Karl Lautenschläger GmbH & Co. KG, Reinheim, Fed. Rep. of Germany

[21] Appl. No.: 788,467

[22] Filed: Nov. 6, 1991

[30] Foreign Application Priority Data

Nov. 6, 1990 [DE] Fed. Rep. of Germany ..... 4035199

[51] Int. Cl.[5] ..... E05D 11/10

[52] U.S. Cl. ..... 16/335; 16/321

[58] Field of Search ..... 16/335, 336, 333, 321, 16/291, 292, 293, 297

[56] References Cited

U.S. PATENT DOCUMENTS

| | | | |
|---|---|---|---|
| 3,835,585 | 9/1974 | Anderson et al. | 16/335 |
| 4,007,513 | 2/1977 | Zerning | 16/333 |
| 4,157,599 | 6/1979 | Holmes | 16/321 |
| 4,177,540 | 12/1979 | Gorton | 16/335 |
| 4,506,409 | 3/1985 | Lautenschläger | 16/291 |
| 4,654,930 | 4/1987 | Lautenschläger, Jr. et al. | 16/291 |
| 5,008,977 | 4/1991 | Lauterschläger et al. | 16/291 |

FOREIGN PATENT DOCUMENTS

| | | | |
|---|---|---|---|
| 2550574 | 5/1977 | Fed. Rep. of Germany | 16/335 |
| 3243805 | 5/1984 | Fed. Rep. of Germany . | |
| 3601682 | 7/1987 | Fed. Rep. of Germany | 16/321 |

*Primary Examiner*—Lowell A. Larson
*Assistant Examiner*—Michael J. McKeon

[57] ABSTRACT

Single-joint hinge (10) for the pivotable attachment of a door element (12), which comes to rest against a cabinet body, with a hinge (16), which is visible in the closed position of the door element and the door element contact part (20) of which has a press-in pot (38), which can be inserted into a recess (36) machined in the edge region in the back of the door element (12), breaking through to the adjacent edge border of the door element, and in which an offset joint component (sliding piece 44), which can be inserted from the edge border parallel to the flat sides of the door element, is attached and which carries the part of the hinge that is assigned to the door element, in the form of a bearing link (54) accommodating the hinge pin, at the end of a projection (52) that is bent at right angles and is extended to the outside of the door element (12). The body contact piece (18) of which single-joint hinge is constructed as an extended supporting arm (22) attached to the body supporting wall (14) assigned to it, the front edge of which supporting arm (22), facing the door element, has a section, which is bent at right angles and is taken to the leading edge of the body wall (14), and two supporting legs (30), which project from there, accommodate between themselves the right-angled projection (52) carrying the hinge assigned to the door element (12) and in the free ends of which the bearing links (12) for the hinge pin are constructed. By arranging a pre-formed bent spring (58), constructed as a leaf spring, in a depression (56) of the right-angled segment (28) of the body contact part and a sliding lug (60) at the area of the offset hinge component (44) which lies opposite the door element contact part (20), a locking device which keeps the door element (12) in the closed position is formed.

8 Claims, 7 Drawing Sheets

SINGLE-JOINT FURNITURE HINGE

The invention relates to a single-joint hinge for the pivotable attachment of a door element, which comes to rest against a cabinet body, with a hinge joint, which is visible in the closed position of the door element and the door element contact part of which has a press-in pot, which can be inserted into a recess machined in the edge region in the back of the door element, breaking through to the adjacent edge border of the door element, and in which an offset joint component, which can be inserted from the edge border parallel to the flat sides of the door element, is attached and which carries the part of the hinge joint that is assigned to the door element, in the form of a bearing link accommodating the hinge pin, at the end of a projection that is bent at right angles and is extended to the outside of the door element, and the body contact piece of which single-joint hinge is constructed as an extended supporting arm attached to the body supporting wall assigned to it, the front end of which supporting arm, facing the door element, has a section, which is bent at right angles and is taken to the leading edge of the body wall, and two supporting legs, which project from there accommodate between themselves the right-angled projection carrying the hinge assigned to the door element and in the free ends of which the bearing links for the hinge pin are constructed.

In addition to the multi-joint hinges, which are used to a great extent in modern furniture and built-in fixtures, single-joint hinges because of the simple and stable structure of their hinge, continue to be used to advantage for those applications where a visible hinge is not disruptive or is even desirable for stylistic reasons, for example, in period furniture. Single-joint hinges are also used to advantage for built-in cabinets in offices, which serve to hold file folders, because in comparison with multi-joint hinges they are less of a hindrance to placing the filing unit in the area of the side walls of the cabinet. The hinges are advisably attached to the door element or the supporting wall, in accordance with the standard of modern multi-joint hinges, on the one hand, by means of a door element contact part, which is inserted in a recess in the back of the door element and constructed as a press-in pot, and, on the other, by means of a body contact part constructed as a supporting arm which can be attached to the supporting wall. Thus, hinges of the initially mentioned type (German patent 32 43 805) are often used in built-in fixtures for coupling the door elements of built-in cabinets. In this connection, it has proven to be advantageous that, for these hinges, the supporting arm can be alternatively used for coupling of a single door element or two laterally consecutive door elements to a supporting wall with so-called twin contact.

As the locking or snapping mechanism for such hinges, catch mechanisms are used, in which a catch element is movably disposed in a recess of the press-in pot or in a hinged part, which is connected with the press-in pot or swivelled with this relative to the supporting arm. Because it is under the tension of a spring, the catch element is in a protruding position. When the hinge is closed, the catch element engages a depression in the opposite surface of the supporting arm. However, the cavity in the press-in pot or the hinged part connected therewith, which is required for adjustable supporting of the catch element and the spring holding the catch element under tension, weakens this hinged part, or requires a clearly more solid construction compared with to similar single-joint hinges without a locking mechanism.

In view of this, it is an object of the invention to provide a locking or snapping mechanism for single-joint hinges of the type in question here, which is constructed in space-saving manner and therefore does not weaken the hinged parts or cause them to be unnecessarily massive, and which is basically suitable both for single contact and for twin contacts.

Starting out from a hinge of the type stated initially, this objective is accomplished pursuant to the invention in that a depression, which is open in the direction of the free ends of the supporting legs is provided in the right-angled segment of the body contact part that connects the front end of the supporting arm with the projecting supporting legs and is taken to the leading edge of the body supporting wall and in which a segment of a preformed bent spring constructed as a leaf spring is disposed so that it essentially covers the depression and the free end of the segment, lying in the area of the supporting legs, can be forced into the depression with elastic deformation at right angles to the leading edge of the supporting wall, in the direction of the leading edge, and in that a projecting sliding lug is formed at the area of the right-angled hinge component, which in the closed position of the hinge lies opposite the free end of the leaf spring segment, on which the free end of the leaf spring segment exerts a locking force that acts in the closing direction in the closed position. The use of a leaf spring, which acts directly together with a sliding lug rigidly provided on the other hinge component, permits the slide lug to be disposed in a relatively shallow depression, since such leaf springs apply sufficiently high locking force, even if they are bent only slightly.

Advisably, the free end of the leaf spring segment, which essentially has a flat surface and interacts with the sliding lug, runs out into an end section which is arched in cross section, pointing back to the leading edge of the supporting wall. The arched end segment transfers the locking force to the sliding lug in the closed position of the hinge.

Advisably, the end opposite the free end of the leaf spring segment is also arched back into the depression and fastened there.

In this connection, the construction can be such that the arc of the end of the leaf spring segment, which curves back into the depression, runs over an arc of the order of about 180° and changes within the depression into a second leaf spring segment, which is essentially flat, and is supported on the bottom of the depression.

The free end of the second leaf spring segment, which is supported on the bottom of the depression can then be bent or canted in the direction of the leading edge of the supporting wall and engage with a fitting slot-like recess in the bottom of the depression.

It is advisable to provide a holding pin, which passes transversely through the depression and comes to rest against the flat side of the second leaf spring segment that faces away from the depression of the bottom, to prevent the second leaf spring segment lifting out of the depression.

Instead of the construction of the leaf spring with two leaf spring segments connected by an arc, an embodiment is also possible in which the end of the leaf spring which is curved back into the depression in arc shape is held in a fitting accommodating slot in the segment of the body contact part, which is bent at right angles and taken to the leading edge of the supporting wall.

The body contact part and at least the right-angled joint supporting component of the door element contact part are made of metal, preferably by die casting. Advisably, the sliding lug is a plastic part, which is produced separately and held in a recess in the right-angled joint supporting component. Compared to the construction of the sliding lug as an integral part of the joint supporting component, which is entirely possible, the use of a separate thrust-carrying, plastic part has the advantage that better sliding and wear properties between the sliding lug and the related leaf spring segment are obtained. The opening, which is required to hold the plastic sliding lug on or in the joint supporting component, can be produced with very small dimensions, since it is not necessary to be able to move this sliding lug, and also since no cavity is required for a pressure spring.

If the inventive hinge is to serve for coupling two door elements to a common body supporting wall with twin contact, and thus two door element contact parts are coupled pivotably on a common body contact part, then this development is such that the joint supporting components of both door element contact parts, which are taken to the outside of the door element, each have a dimension corresponding to approximately half the clear distance between the supporting legs in their region, which engages between the supporting legs of the body contact part.

In this connection, the region of the joint supporting components of the door element contact parts which engage between the supporting legs of the body contact part, are offset in such a way in the height direction to the horizontal bisecting plane of the door element contact parts, that the door element contact parts, coupled to the body contact part in opposite directions, are aligned in the height direction.

The invention is explained in greater detail in the following description of various embodiments, in conjunction with the drawing.

Figure 1:
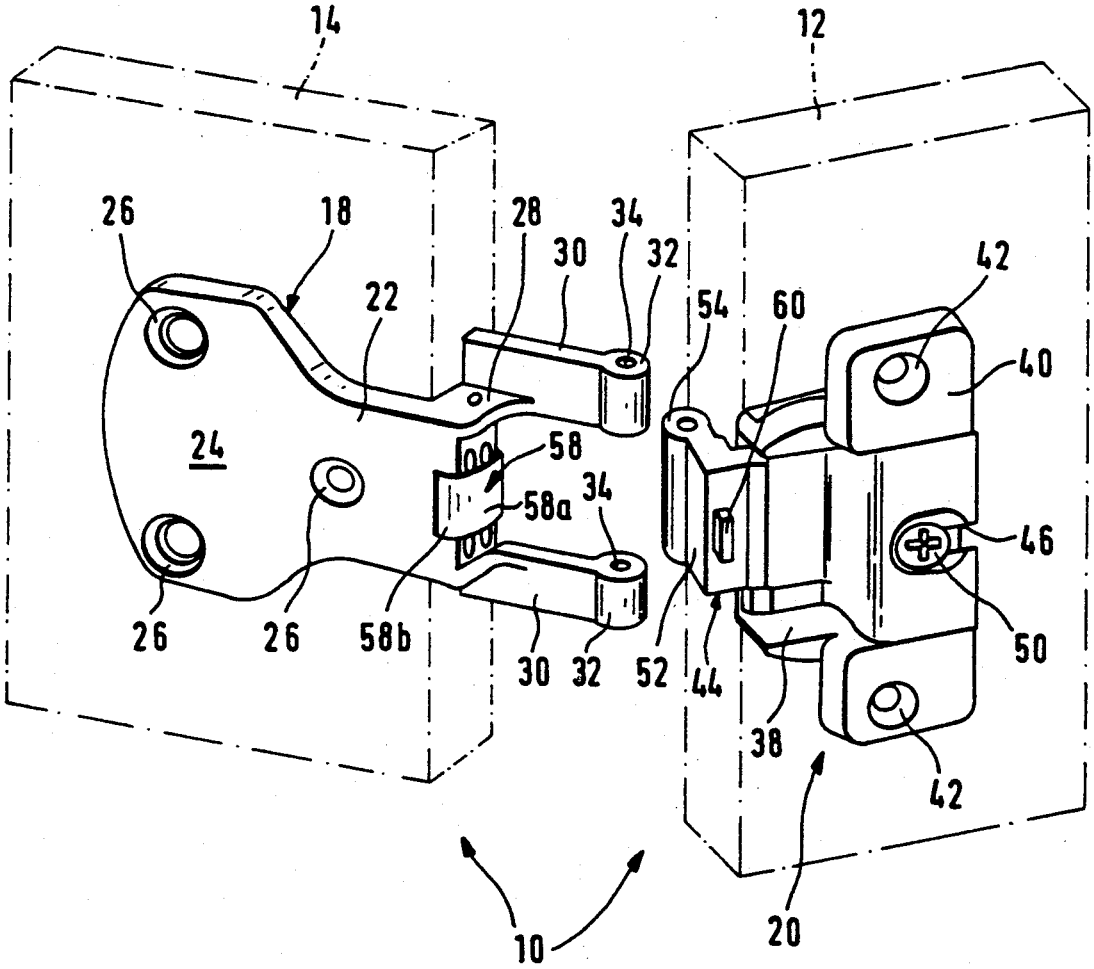
FIG. 1 shows a perspective view of a single-joint hinge, constructed in the inventive manner, the body and the door element contact part being shown separated from one another and pulled apart in the area of the joint, and the supporting wall as well as the door element each being indicated only with dot-dash lines.
Figure 5:
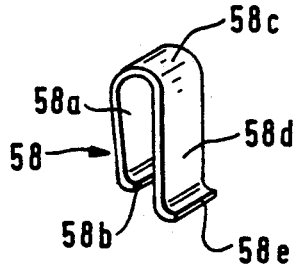
FIG. 5 shows a perspective view of the leaf spring provided in the embodiments of to FIGS. 2 to 4.
Figure 2:
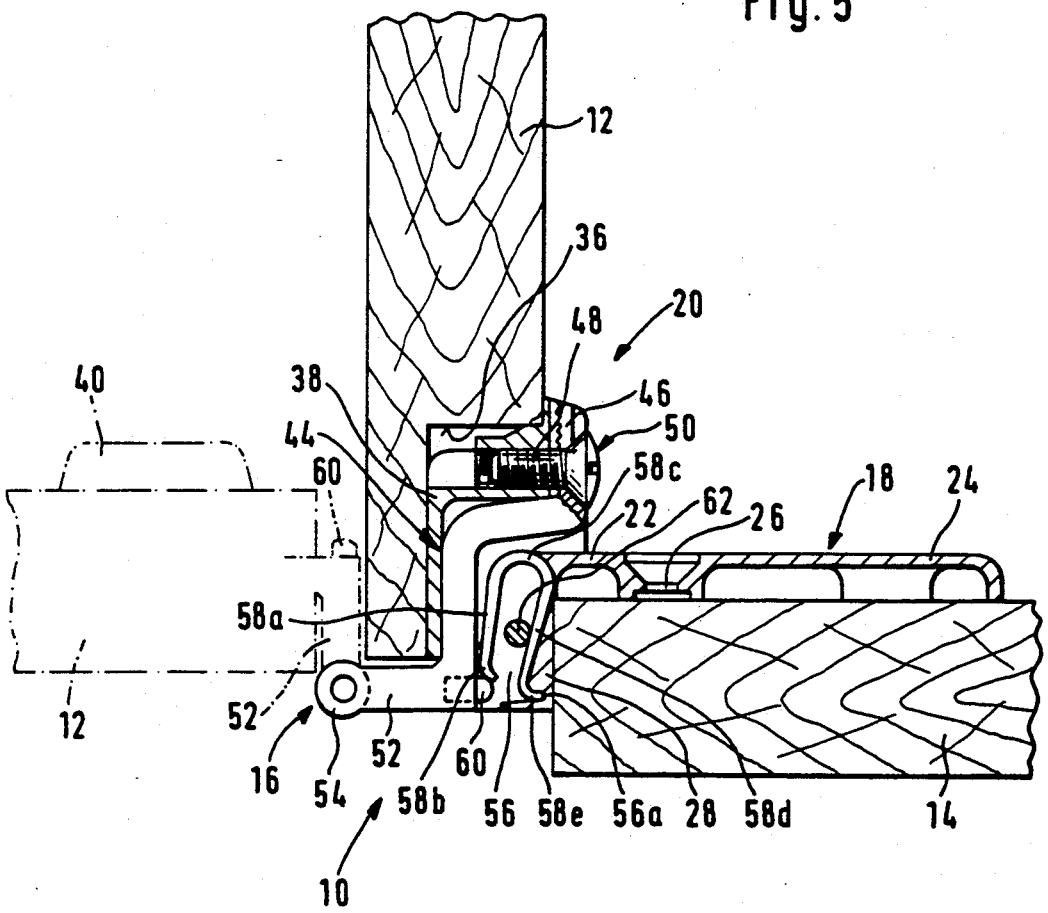
FIG. 2 shows a longitudinal cross section through a first embodiment of the inventive hinge in the closed position.

The single-joint hinge is shown in a perspective view in FIG. 1 and, as a whole, is labelled 10. It serves for the pivotable mounting of a door element 12, on the supporting wall 14, such as the side wall of a cabinet body, as can be seen in FIGS. 2 to 4 and 6 to 8, which show different embodiments. The actual hinge 16 is placed in front of the front side of the door element, so that the door element when it is opened can be pivoted through at least 180° as far as the front of an optionally present, adjacent, second door element 12. In FIG. 2, the door element 12, opened through 90°, is shown with dot-dash lines in addition to the door element in the closed position. In FIG. 4, the door element 12 is opened through 180°, while in FIG. 3, the door element 12 is shown in an open/closed position, in which the locking or snapping mechanism, which holds the door element in the fully closed position, just becomes inactive with reference to an opening movement of the door element out of the closed position, or just becomes active with reference to a closing movement of the door element. It is furthermore evident that the position of the hinge 16 also allows the door element to be opened beyond an opening angle of 180°, up to the outside of the supporting wall, when this supporting wall is the outermost side wall of the cabinet.

The basic structure of the different embodiments shown in the drawing is the same. Therefore this development of the body contact part 18, which is connected by the hinge 16, as well as that of the door element contact part 20, will be described first. In FIG. 1, these two contact parts 18, 20 are shown in a separated position, that is, separated by removal of the joint pin, which normally holds them together. The body contact part 18 has the shape of an extended supporting arm 22, which is enlarged in its rear end region, that is in the region pointing into the interior of the cabinet, to form a flange plate 24. In the case shown, the flange plate 24 is interspersed with mounting boreholes 26, which are disposed triangularly to one another. Bolts (not shown) can be screwed through the mounting boreholes 26 into the facing, flat side of the supporting wall 14. On the front end of the supporting arm 22 on the door element side, a right-angled segment 28, which is taken to the leading edge of the supporting wall 14, is attached in one piece from which two supporting legs 30, offset in height, project at right angles from the leading edge of the supporting wall 14. The flush supporting boreholes 34 for the hinge pin, which couples the door element contact part 20 of the hinge 10 pivotably with the supporting wall contact part 18, are constructed in the sleeve-like, thickened free ends 32 of the supporting legs 30.

The door element contact part 20 is essentially countersunk in a recess 36 in the back of the door element. This recess, which is essentially circular in outline in plan view, is drilled or milled into the edge region of the back of the door element, so that it goes to the outside in the edge border of the door element 12. The part of the door element contact part, which is inserted in the recess 36, has the shape of a press-in pot 38, which is open towards the inside of the body and towards the edge border of the door element. The press-in pot 38 can be attached to the door element by means of an attachment flange 40 with countersunk mounting boreholes 42. The attachment flange 40 rests on the back of the door element 12 and protrudes beyond the actual pot diameter. Inside the press-in pot 38, which is open towards the edge border of the door element, a guided sliding piece 44 is disposed, which can be moved parallel to the flat sides and at a right angle to the edge border of the door element 12. This guided slide piece 44 is held in the press-in pot by means of mounting screw 50, which passes through an elongated longitudinal slot 46 and is screwed into a threaded bore 48 in the press-in pot 36, in the orientation previously set in the press-in pot before the mounting screw 50 is tightened. To secure the relative setting of the sliding piece 44 in the press-in pot 38, the surfaces of the two parts, which are pressed against each other, when the mounting screw 50 is tightened, can be provided with grooves or teeth.

At its end projecting from the open end of the press-in pot 38, the sliding piece 44 has a right-angled projection 52 which is bent over at a right angles and taken to the outer flat side of the door element 12. The width of this right-angled projection 52 measured in the vertical direction, corresponds to the clear distance between the supporting legs 30. The bearing link 54 for the pin of the hinge in turn is formed at the free end of the right-angled segment 52. In this regard, the hinge 10 described essentially corresponds in function to the single-joint hinge 10, which is known from the state of the art (German patent 32 43 805), however one which does not have an integrated locking or snapping mechanism.

To form the locking mechanism, a depression 56 which is open in the direction of the free ends of the supporting legs 30 is provided in the right-angled segment 28 of the body contact part 18, which is taken to the leading edge of the body supporting wall. In this depression 56, a segment **58*a* of a pre-formed bent spring 58, which is constructed as a leaf spring, is arranged so that it essentially covers the depression 56. The free end of this segment 58*a*, lying in the area of the supporting legs 30, can be forced with elastic deformation, at a right angle to the supporting wall leading edge, in the direction of the leading edge into the depression 56**.

A projecting sliding lug 60 is formed at the area of the right-angled projection 52 of the part of the door element contact part 20 that lies opposite the free end of the leaf spring segment **58*a* in the closed position of the hinge. In the closed position, the free end of the leaf spring segment 58*a* exerts on the sliding piece 44** a locking force, which acts in the closing direction.

For this purpose, the free end of the otherwise essentially flat leaf spring segment 58, runs out into an arc-shaped end segment **58*b***, which points back in cross section to the leading edge of the supporting wall.

The end of the leaf spring segment 58 opposite the end segment **58*b* also curves back arc-shaped into the depression 56 and is then attached in the depression in suitable manner. The construction of the leaf spring 58 will first be described in the form realized in the embodiments of FIGS. 2 to 5. To begin with, however, it must be pointed out that the sliding lug 60 can be a rib-like projection, protruding in one piece from the sliding piece 44. Preferably, however, the sliding lug 60 is a separately produced plastic part, which is held in a recess in the offset sliding piece 44, in order thus to improve the sliding behavior between the surfaces of this sliding lug, which interact with the arc-shaped end segment 58*b* of the segment 58*a*** of the leaf spring, and to minimize wear.

Figure 3:
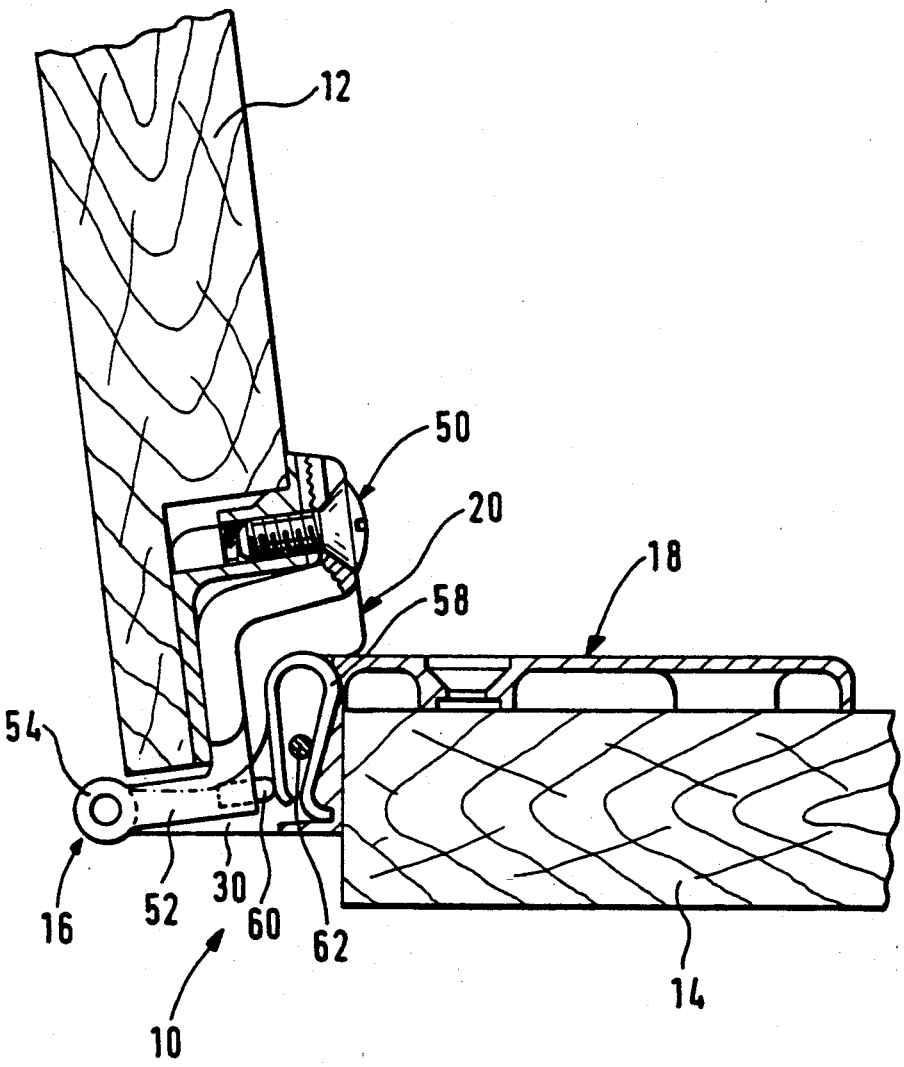
FIG. 3 shows a sectional view of the hinge shown in FIG. 2, in a position in which the door element is pivoted in the open direction to such an extent, that the locking mechanism is just deactivated.
Figure 4:
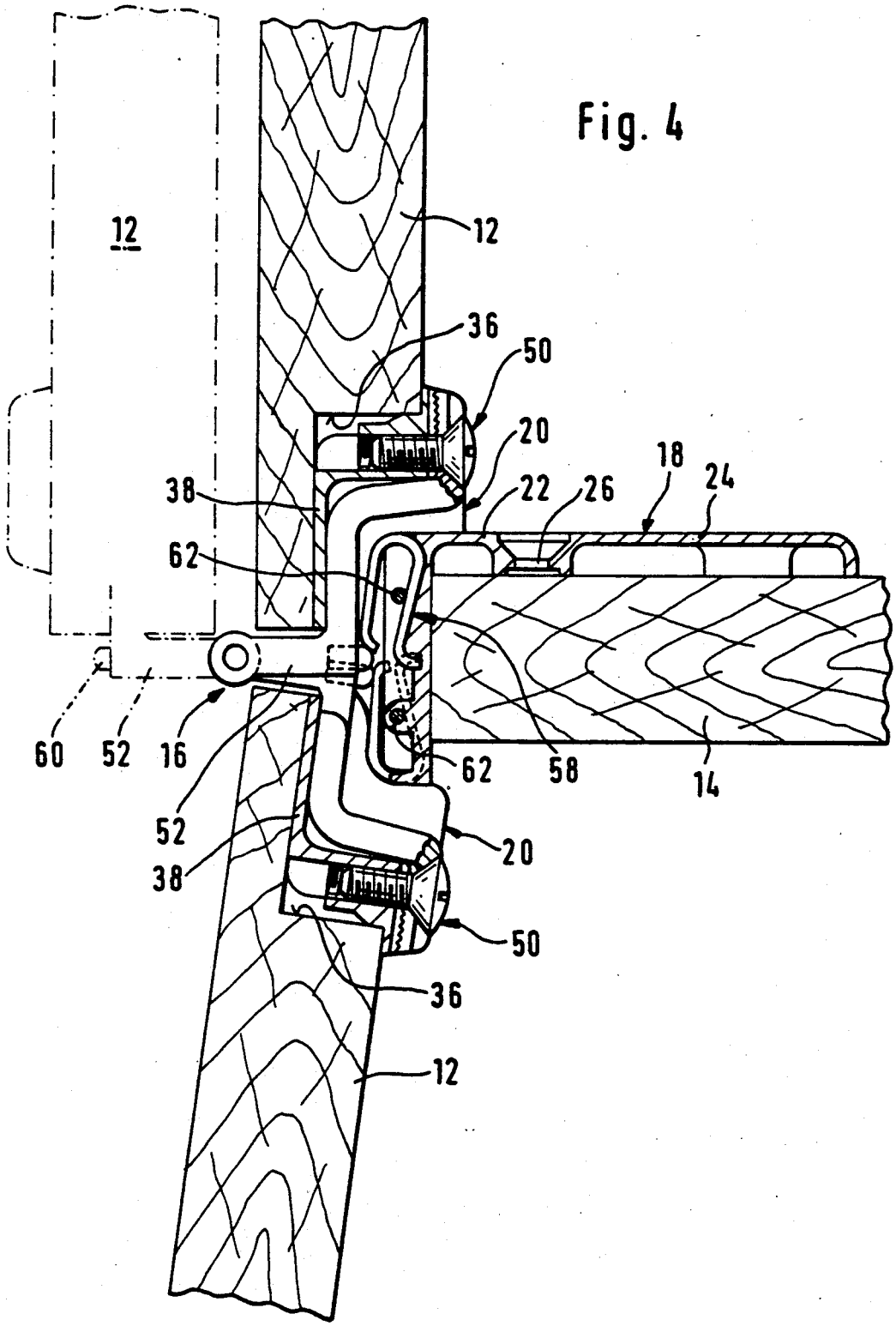
FIG. 4 shows a longitudinal cross section through a hinge, which corresponds to the hinge to FIGS. 2 and 3 with regard to the locking mechanism, for the twin-contact of two laterally adjoining door elements on a common supporting wall.

In FIGS. 2 and 3, the single-joint hinge 10 which is shown in perspective and pulled apart in FIG. 1, is shown in a horizontal cross section. The function of the locking or snapping mechanism, the leaf spring 58 of which is shown separately in FIG. 5, can be seen. It is evident that the end of the segment **58*a*, which can be bent elastically and lies opposite the arc-shaped end segment 58*b* of the leaf spring 58, is also bent back arc-shaped into the depression, and, moreover through an angle of the order of about 180°. This arc-shaped end segment 58*c* then changes into an essentially flat leaf spring segment, which rests flat on the bottom of the depression 56. The free end of this leaf spring segment 58*d*, in turn, is curved or bent over in the direction of the leading edge of the supporting wall 14. This curved end segment 58*a* engages slot-like recess 56*a* in the bottom of the depression 56. By these means, the leaf spring 58 is positively held in the depression 56, so that it cannot be shifted. The second leaf spring segment 58*d* is kept from exiting from the depression by means of a holding pin 62, which passes transversely through the depression 56*a* and is pressed into the depression through boreholes in the wall segments of the right-angled segment 28**, which form the side boundaries of the depression.

FIG. 4 shows a variation of the hinge 10 shown in FIGS. 2 and 3 in these sense that, instead of one door element contact part 20, now two such door element contact parts are mounted pivotably on the supporting wall contact part 18, with a so-called "twin contact." In order for this to be possible, the right-angled projections 52 of the sliding pieces 44 of the two door element contact parts 20, which are mounted between the supporting legs 30 of the body contact part, each are only half as wide as the clear distance between the supporting legs 30. These right-angled projections 52 are offset in height relative to the horizontal, bisecting plane of each door element contact part 20, so that press-in pots 38 of the two door element contact parts 20 are in alignment with reference to their bisecting plane.

Figure 6:
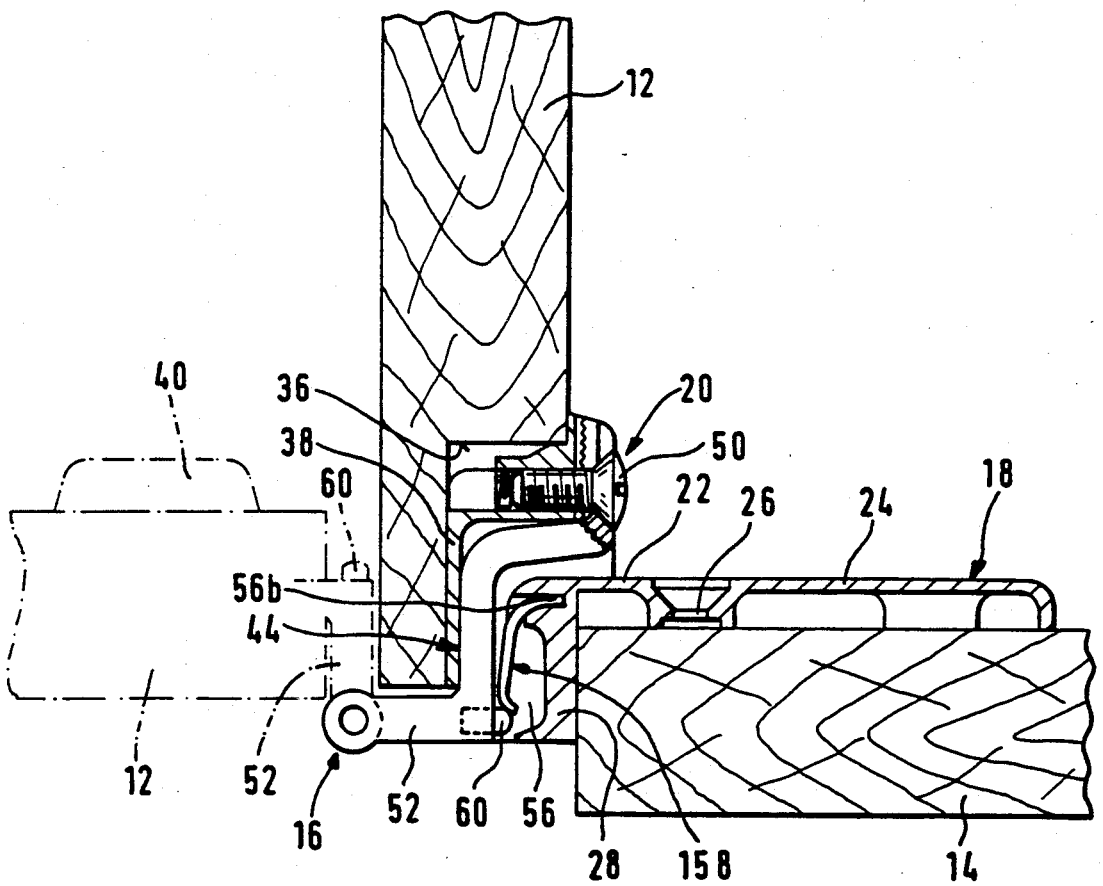
FIG. 6 shows a longitudinal cross section through a second embodiment of the inventive single-joint hinge in the closed position.
Figure 7:
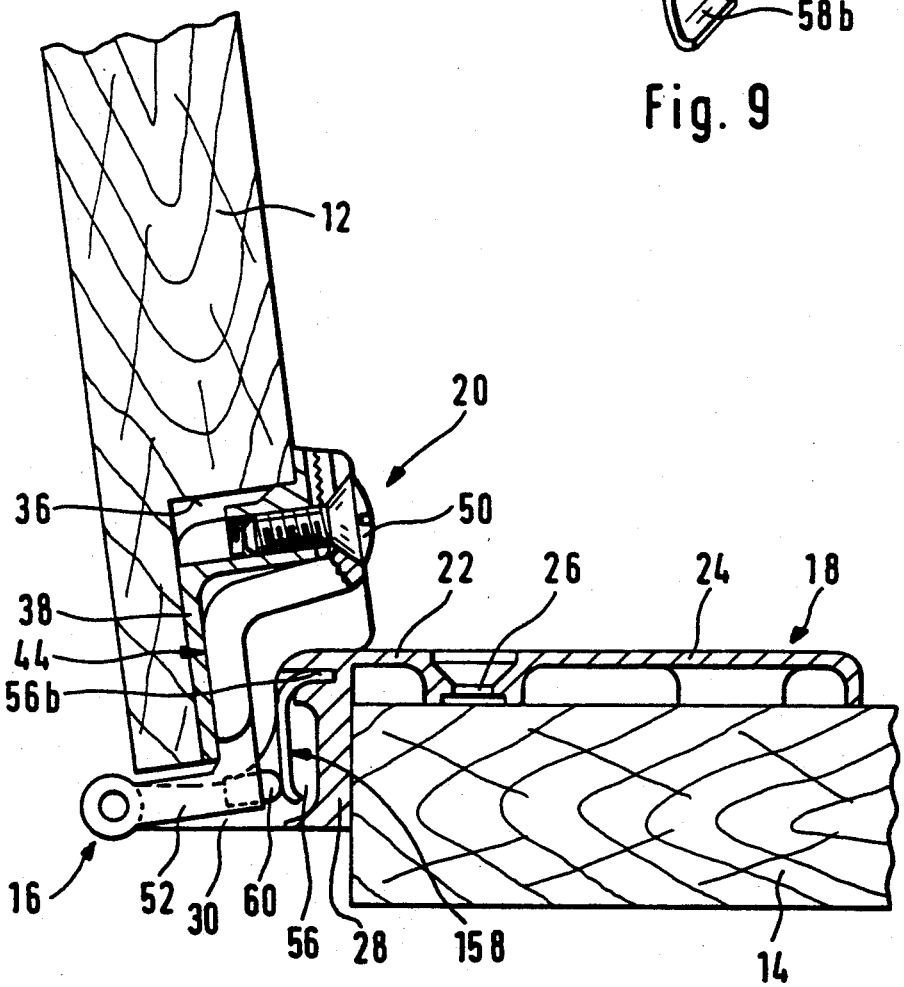
FIG. 7 shows the hinge in FIG. 5 in the slightly opened position corresponding to that of FIG. 3.

In FIGS. 6 and 7, as well as 8, hinges are shown, which are modified only with respect to the layout and attachment of leaf spring 158, which is different from the leaf spring 58 of the embodiments of FIGS. 1 to 3 and 4. In addition, leaf spring 158 is shown separately in FIG. 9. The hinged, reproduced in FIG. 6 and 7, is again used to couple a door element 12 to the supporting wall 14 of a cabinet body, while the hinge shown in FIG. 8 makes possible the pivotable coupling of two door elements 12 with a supporting wall 14 with twin contact by means of two door element contact parts 20 coupled to the supporting wall contact part 18.

In order to avoid repetitions, only the changes made in the layout of the leaf spring relative to the hinges of FIGS. 1 to 3 and 4, and in the nature of the attachment of the modified leaf spring 158 in the depression 56 will be described. As for the remainder, reference can be made to the preceding description of FIGS. 1 to 4, particularly since identical parts of the hinges have been given the same reference numbers in the drawings.

Figure 9:
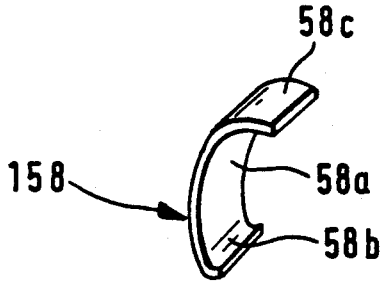
FIG. 9 shows a perspective view of the leaf spring used in the embodiments of FIGS. 6 to 8.

The leaf spring 158, again shown separately in FIG. 9, also has an essentially flat, elastic segment 58, which can be bent and, at its free oscillating end, runs out into an arc-shaped end segment **58*b* pointing back to the leading edge of the supporting wall 14. At the opposite end, an arc-shaped segment 58*c*, which extends over a lesser angle of the order of 90°, is connected. However, this arc-shaped segment 58c is pushed directly into a fitting slot-like recess 56b** in the depression, and is held there, for example, by being wedged in.

Figure 8:
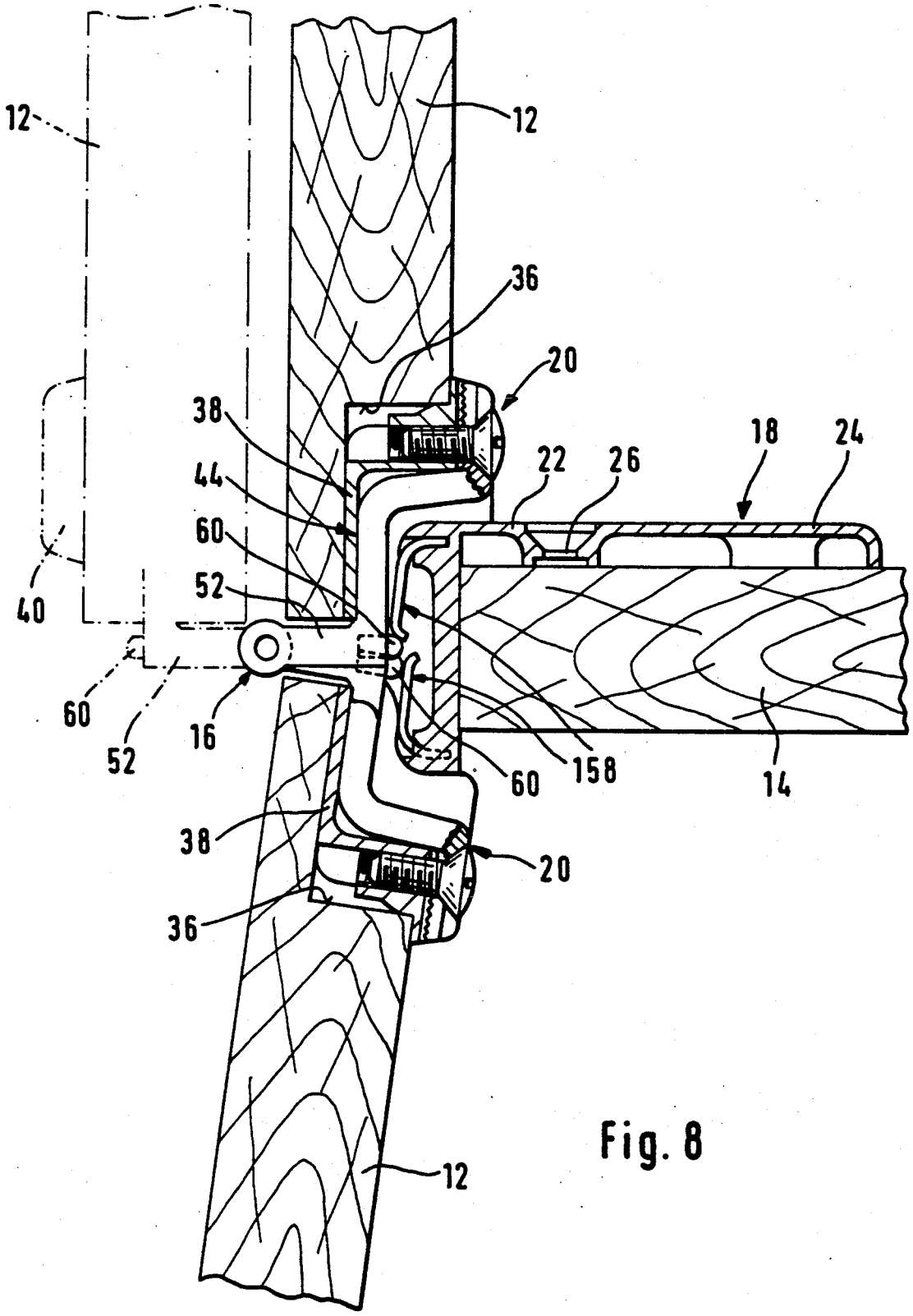
FIG. 8 shows the embodiment of FIGS. 6 and 7 in the further development corresponding to the hinge of FIG. 4, as a hinge for twin-contact.

It should still be added that in the case of the hinges shown in FIGS. 4 and 8, in which two door element contact parts 20 in each case are coupled to a supporting wall contact part 18, each of the two door element contact parts has not only a right-angled projection 52 reduced to half the width, but also a separate sliding lug 60. A separate leaf spring 58 and 158 is assigned to each sliding lug 60. The separate leaf springs 58 and 158 are disposed in the assigned depression offset to one another in height and horizontal directions. In order to make possible the arrangement of the second leaf spring so as to be offset in the horizontal direction, the right-angled segment 28 of the supporting wall contact part 18 is extended beyond the side of the supporting legs 30 averted from the supporting wall, in order to make possible there the construction of the depression 56 for the arrangement of the leaf spring 58 or 158 assigned to the second door element contact part 20 to be formed there. While the right-angled segment 28 extends only to about the center of the leading edge of the supporting wall 14 in the case of a normal contact for a door element, it essentially covers the leading edge of the supporting wall 14 completely in the case of a hinge for twin contact.

I claim:

1. A single-joint hinge assembly for the pivotable attachment of a door element to a cabinet wall against which it rests in a closed position, the hinge assembly comprising a door element contact part and a cabinet wall contact part which are pivotably joined at a hinge pivot portion, the hinge pivot portion being visible when the door element is in the closed position, the door element contact part comprising a pot-shaped element which can be press-fitted into a recess machined in the face of the door element which faces the cabinet wall, the recess opening out into a hinged edge of the door element, the pot-shaped element having an offset joint component slidingly inserted in an inward direction from the hinged edge of the door element parallel to the face of the door element for attachment to the pot-shaped element, the offset joint component carrying the door element contact part of the hinge assembly by way of a bearing link accommodating a hinge pin, the bearing link being at the end of a projection, the projection being an extension of the offset joint component perpendicular thereto and extending outward of the hinged edge of the door element, the cabinet wall contact part comprising an extended supporting arm attached to an inside face of the cabinet wall, the supporting arm having an extension thereof perpendicular to the face of the cabinet wall and adjacent a hinged edge thereof, the supporting arm extension having two supporting legs projecting outward from the hinged edge of the cabinet wall and spaced apart to accommodate therebetween the extension of the offset joint component of the door element contact part, free ends of the supporting legs having bearing links for accommodating the hinge pin, the perpendicular extension of the supporting arm having therein a depression opening out in the direction of the legs, a leaf spring disposed in the depression and secured via a connecting end of the leaf spring, the leaf spring being situated so that it essentially covers the depression and is biased outward from the depression, the leaf spring comprising an essentially flat body portion and a free end portion which arcs inward toward the edge of the cabinet wall, a projecting sliding lug positioned at the extension of the offset joint component such that the lug lies opposite the leaf spring when the door element is in the closed position, the arc-shaped free end of the leaf spring exerting a force against the lug to thereby bias the door element in a closing direction as it approaches the closed position.

2. The hinge assembly of claim 1, wherein the connecting end of the leaf spring is also arched back into the depression.

3. The hinge assembly of claim 2, wherein the arc of the free end of the leaf spring runs over an arc of the order of about 180° to comprise within the depression a second leaf spring segment, which is essentially flat, and is supported on the bottom of the depression.

4. The hinge assembly of claim 3, wherein a free end of the second leaf spring segment, which is supported on the bottom of the depression, is canted in the direction of the hinged edge of the cabinet wall and engages a conforming slot-like recess in the bottom of the depression.

5. The hinge assembly of claim 3, wherein the second leaf spring segment is held by a holding pin which passes transversely through the depression, and comes to rest against the flat side of the second leaf spring segment that faces away from the bottom of the depression.

6. The hinge assembly of claim 2, wherein the connecting end of the leaf spring is held in a conforming accommodation slot in the perpendicular extension of the cabinet body contact part.

7. The hinge assembly of claim 1, wherein the cabinet body contact part and the offset joint component of the door element contact part are made of metal, and the lug is a separate plastic part held in a recess in the offset joint component.

8. A single-joint hinge assembly for the pivotable attachment of two opposing door elements to a common cabinet wall against which they rest in a closed position, the hinge assembly comprising two door element contact parts and a cabinet wall contact part which are pivotably joined at a hinge pivot portion, the hinge pivot portion being visible when the door elements are in the closed position, each door element contact part comprising a pot-shaped element which can be press-fitted into a recess machined in the face of the door element which faces the cabinet wall, the recess opening out into a hinged edge of the door element, the pot-shaped element having an offset joint component slidingly inserted in an inward direction from the hinged edge of the door element parallel to the face of the door element for attachment to the pot-shaped element, the offset joint component carrying the door element contact part of the hinge assembly by way of a bearing link accommodating a hinge pin, the bearing link being at the end of a projection, the projection being an extension of the offset joint component perpendicular thereto and extending outward of the hinged edge of the door element, the cabinet wall contact part comprising an extended supporting arm attached to an inside face of the cabinet body, the supporting arm having an extension thereof perpendicular to the face of the cabinet body and adjacent a hinged edge thereof, the supporting arm extension having two supporting legs projecting outward from the hinged edge of the cabinet body and spaced apart to accommodate therebetween the extension of the offset joint component of both door element contact parts, the two offset joint component extensions being arranged one on top of the other within the space between the legs, each offset joint component extensions having a dimension such that the sum thereof equals the dimension of the space between the legs, free ends of the supporting legs having bearing links accommodating the hinge pin, the perpendicular extension of the supporting arm having therein two depressions opening out in the direction of the legs, a leaf spring disposed in each depression and secured via a connecting end of the leaf spring, each leaf spring being situated so that it essentially covers the depression in which it is secured and is biased outward from the depression, each leaf spring comprising an essentially flat body portion and a free end portion which arcs inward toward the edge of the cabinet wall, a projecting sliding lug positioned at the extension of each offset joint component such that the lug lies opposite a respective leaf spring when corresponding door element is in the closed position, the arc-shaped free end of the leaf spring exerting a force against the lug to thereby bias the door element in a closing direction as it approaches the closed position, such that each door element can pivot on the hinge assembly independently from the other door element.

* * * * *